United States Patent [19]

Reytblatt

[11] 4,148,292

[45] Apr. 10, 1979

[54] ENERGY CONVERSION DEVICES

[76] Inventor: Zinovy Reytblatt, 530 W. Aldine, Chicago, Ill. 60657

[21] Appl. No.: 734,448

[22] Filed: Oct. 21, 1976

[51] Int. Cl.[2] ..... F02B 55/00; F03C 3/00

[52] U.S. Cl. ..... 123/245; 418/35

[58] Field of Search ..... 418/33, 34, 35; 123/8.47, 245

[56] References Cited

U.S. PATENT DOCUMENTS

| | | | |
|---|---|---|---|
| 830,124 | 9/1906 | Weeks | 418/35 |
| 3,087,671 | 4/1963 | Myles | 418/34 |
| 3,304,921 | 2/1967 | Prochazka et al. | 418/35 X |
| 3,481,313 | 12/1969 | Isstas | 418/195 X |
| 3,549,286 | 12/1970 | Moriarty | 418/68 X |
| 3,730,145 | 5/1973 | Benneto | 418/68 X |

*Primary Examiner*—Carlton R. Croyle
*Assistant Examiner*—Leonard E. Smith
*Attorney, Agent, or Firm*—Van Metre Lund

[57] ABSTRACT

The invention relates to energy conversion devices for converting between fluid flow energy and rotational mechanical energy, utilizing "Coriolis" forces which are produced when there is a relative motion velocity non-parallel to an instant rotation axis direction. In one embodiment, two piston members move around in an annular chamber of a housing member journalled on a support member for rotation relative thereto about a first axis extending in a diametral plane of the annular chamber, the support member being journalled for rotation about a second axis intersecting and transverse to the first axis, the second axis being a stationary axis forming the principal axis of rotation. With pressurized fluid applied to move the pistons around, the device operates as an engine. In a second embodiment, means are provided for effecting combustion of an air-fuel mixture within the annular chamber, to provide an internal combustion engine. A third embodiment is similar to the second embodiment except that three pistons are provided in a manner to provide intake and compression operations within the annular chamber. In a fourth embodiment, pistons oscillate within cylindrical chambers of a housing member which is supported on a support member for rotation about an axis angularly related to the axes of the cylindrical chambers, the support member being supported for rotation about a second axis intersecting and transverse to the first axis, and with means being provided for effecting combustion within the chambers to oscillate the pistons.

5 Claims, 11 Drawing Figures

ENERGY CONVERSION DEVICES

This invention relates to devices for energy conversion between rotational mechanical motion and fluid flow and more particularly to devices which are highly efficient, smooth and vibration-free in operation and which with a given size and weight will convert energy at a rapid rate without operating at excessive speeds. The devices have a relatively few number of operating parts and are otherwise simple and economical in operation and construction.

BACKGROUND OF THE PRIOR ART

In my Russian Pat. No. 85694 of June 25, 1950, I disclosed a device including a pair of hollow annular members mounted to rotate on a common axis at right angles to a principal axis of rotation, the two members being rotatably supported on a support member rotatable on the principal axis, with bevel gears carried by the two members being meshed with a stationary bevel gear and with a fluid inlet and a fluid outlet being arranged to communicate with the space on the interior of the two members. When the carrier member is rotated both of the two annular members rotate in synchronism about the two axes and so-called "Coriolis" forces act on the fluid inside the two members. Such Coriolis forces cause the fluid to move from the inlet to the outlet when power is applied to cause the aforesaid movements of the members. If, on the other hand, pressurized fluid is supplied to the inlet, the device will be driven to operate as an engine.

The device of my aforesaid patent has limitations in that relatively high rotational and fluid velocities are required, especially with respect to operation as an engine to obtain a substantial power output to drive a load.

Conventional reciprocating engines and pumps require crank shafts and cam shafts and are generally complex with respect to construction, operation and manufacture. They also are not smooth in operation and produce substantial vibrations and noise. Other types, such as rotary engines, avoid some of the disadvantages of reciprocating engines but introduce other problems especially with regard to obtaining effective seals to surfaces of complex contour.

SUMMARY OF THE INVENTION

This invention was evolved with the general object of overcoming the disadvantages of prior art engines including that of my prior Russian patent and of providing devices which are highly efficient, smooth and vibration-free in operation and of relatively small size with amount of power converted, in which will also operate at relatively low speeds.

An important aspect of the invention is in the recognition of a problem with respect to the device of my aforesaid Russian patent in that the forces which are applied to develop the output torque, in the case of operation as an engine, are developed between the fluid and the walls of the chamber in which the fluid moves and if the fluid has a low mass density as in the case of a gaseous fluid, the forces are not great and high fluid velocities are required to develop a substantial output torque. Recognizing this problem, piston means are arranged to be moved by the fluid and provide a relatively large mass so as to develop large forces at relatively low velocities.

In one embodiment, a housing member is journalled on a support member for rotation relative thereto about a first axis and the support member is driven for rotation about a second of axis which may preferably intersect and be transverse to the first axis, the second axis being a stationary axis forming the principal axis of rotation. The housing member provides a chamber for movement of piston means therewithin, the chamber being an annular chamber in the first embodiment. Also, in the first embodiment two pistons are provided with means being provided to lock one piston against movement while the other is moved by a pressurized fluid applied through an inlet on one side of the stationary piston to expel fluid out through an outlet on the other side of the stationary piston. With continued movement of the moving piston, the stationary piston is released and the moving piston is locked in the position previously occupied by the stationary piston which then becomes the moving piston.

The first embodiment is operable as an engine and with simultaneous rotation of the housing member about its axis and the support member about its axis to develop Coriolis forces, such forces are applied from the pistons to the walls of the chamber.

A second embodiment is similar to the first embodiment but is operable as an internal combustion engine with combustion taking place between a piston held in a stationary position and a second piston which in moving around toward the stationary piston exhausts gases from a previous combustion out through an outlet passage.

In a third embodiment, also operable as an internal combustion engine, three pistons are provided and during part of an operating cycle, two of the pistons are held stationary while the third operates to draw in an air-fuel mixture between it and one of the stationary pistons while compressing an air-fuel mixture between it and the other of the stationary pistons.

In a fourth type of construction, at least one piston is movable in an oscillatory path which may preferably be linear and at an angle to the axis of rotation of the housing member relative to the support member. Thus, the chamber in the housing member may be cylindrical and readily and accurately formed. In this type of construction, means may be provided for effecting combustion of an air-fuel mixture within the chamber, for operation as an internal combustion engine.

All of the constructions have important advantages in that no crank shafts and associated parts are required, the interengaging surfaces of pistons and housing walls may be regular and adapted to utilize conventional effective types of seals. Also, the devices are relatively smooth and vibration-free in operation.

Other objects, features and advantages will become more fully apparent from the following detailed description taken in conjunction with the accompanying drawings which illustrate preferred embodiments of the invention.

DESCRIPTION OF PREFERRED EMBODIMENTS

Figure 2:
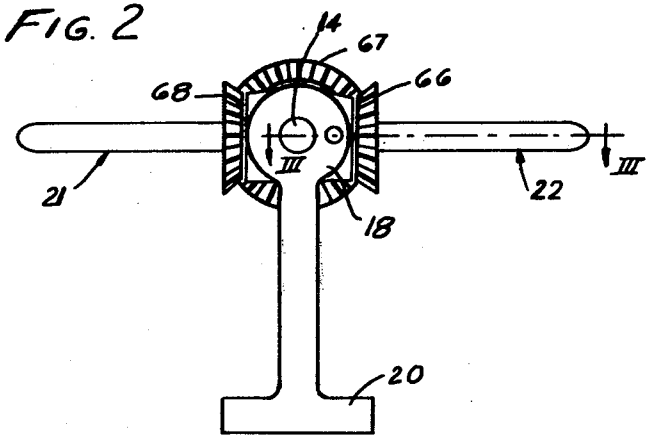
FIG. 2 is an end elevational view of the device shown in FIG. 1.
Figure 1:
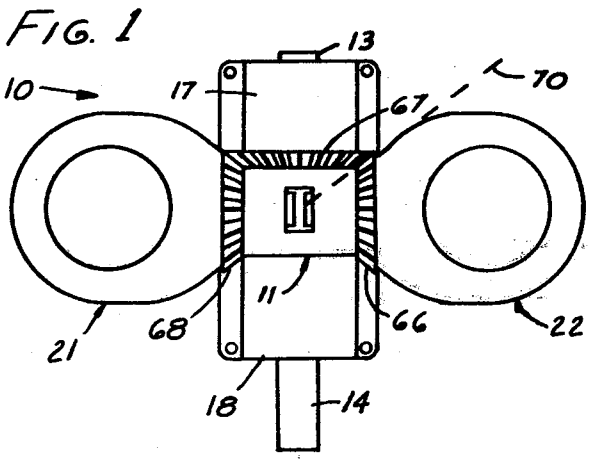
FIG. 1 is a top plan view of one preferred type of device constructed in accordance with the principles of the invention.
Figure 3:
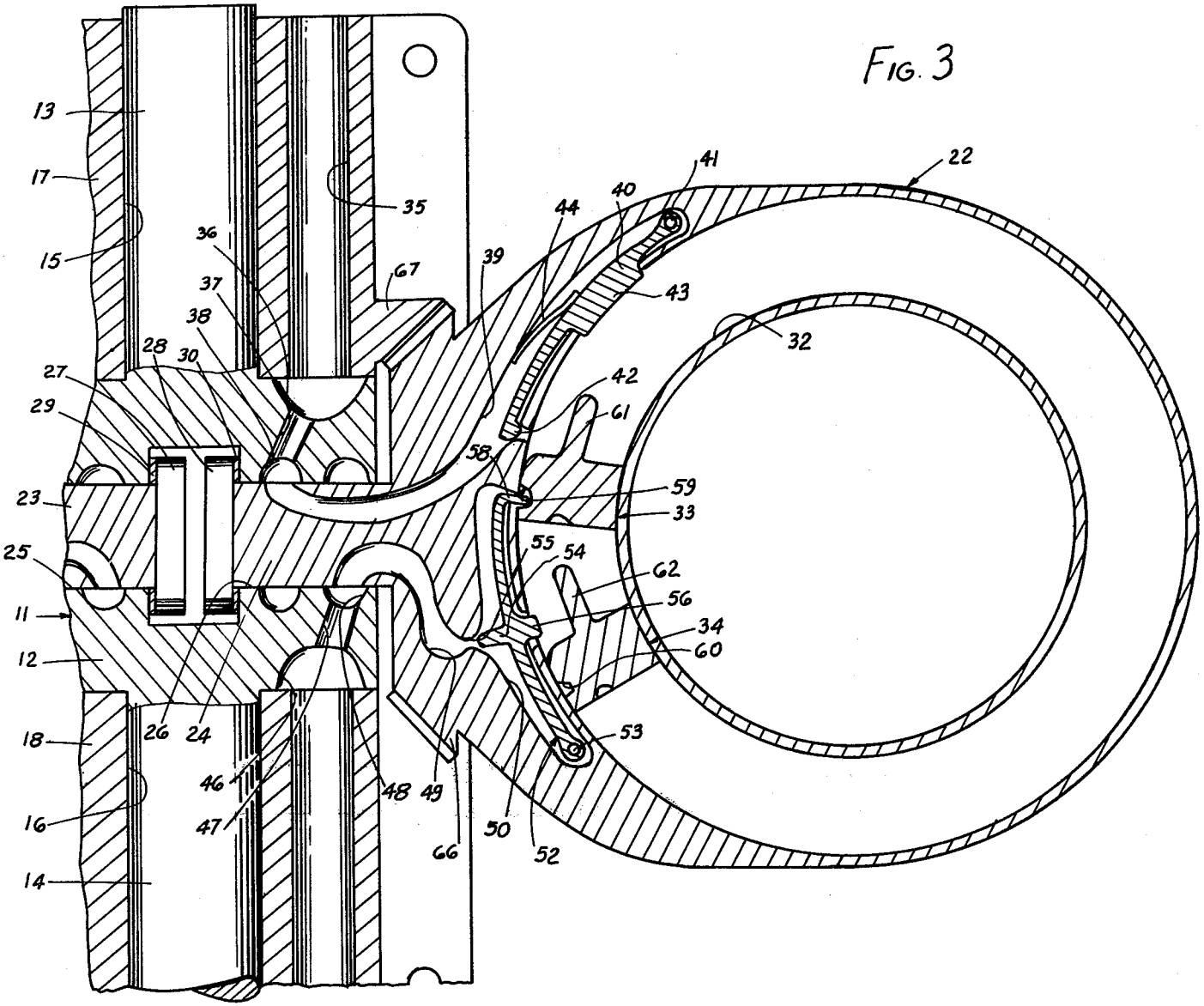
FIG. 3 is a cross-sectional view, taken substantially along line III—III of FIg. 2.

Referring to FIGS. 1-3, reference numeral 10 generally designates one preferred type of device constructed in accordance with the principles of the invention, designed for use as an external combustion engine using steam or other high pressure fluid.

The illustrated device 10 comprises a rotatable support member 11 which includes a central portion 12 and oppositely projecting shaft portions 13 and 14 journalled in bearing openings 15 and 16 of a pair of members 17 and 18 which are supported through depending leg portions thereof from a suitable base member 20. The central portion 12 of the rotatable member 11 carries a pair of housing members 21 and 22 which have integral shaft portions 23 and 24 journalled in bearing openings 25 and 26 in the member 11, for rotation about a common axis which is transverse to the axis of rotation of the member 11. A pair of collars 27 and 28 are secured to the inner ends of the shaft portions 23 and 24, and suitable thrust bearing elements 29 and 30 may be provided between the outer faces of the collars 27 and 28 and inwardly facing surface portions of the member 11.

Each of the housing members 21 and 22 has an annular chamber therewithin in which a pair of pistons are disposed, the construction with respect to member 22 being shown in the cross-sectional view of FIG. 3. The annular chamber in member 22 is indicated by reference numeral 32 and the pistons are indicated by reference numerals 33 and 34.

The annular chamber 32 in member 22 is adapted to communicate with a fluid inlet port or passage 35 in the journalling member 17. In particular, the passage 35 extends to an annular chamber 36 in an axially facing surface of the central portion 12 of member 11, the axis of chamber 36 being coincident with the axis of rotation of member 11. Chamber 36, in turn, communicates through one or more ports 37 with an annular chamber 38 in the portion 12 extending around the shaft portion 24 of the member 22. Chamber 38 communicates with a passage 39 in the member 22 which is adapted to communicate with the annular chamber in member 22 under control by a valve element 40. Valve element 40 is supported at one end by a pin 41 and at its opposite end, member 40 is formed with a valve portion 42 adapted to seat in an opening in a wall portion of the member 22 between the passages 39 and the annular chamber 32 of the member 22. At an intermediate point, the member 40 is formed with a portion 43 which projects through an opening in the wall of the member 22, between passage 39 and chamber 32. A leaf spring element 44 urges the member 40 inwardly to seat valve portion 42.

The annular chamber 32 in member 22 is also adapted to communicate with a fluid outlet port or passage 45 in the journalling member 18. In particular, the passage 45 extends to an annular chamber 46 in an axially facing surface of the central portion 12 of member 11. Chamber 46, in turn, communicates through one or more ports 47 with an annular chamber 48 in the portion 12, extending around the shaft portion 24 of the member 22, the chamber 48 being in axially spaced relation to the chamber 38. Chamber 48 communicates with a passage 49 in the member 22 which is adapted to communicate with a chamber 50 in the member 22, under control of a valve element 52. Valve element 52 is pivotally supported at one end by a pin 53 and at an intermediate point, it is formed on one side with a valve portion 54 adapted to seat in an opening 55 of restricted size, between passage 49 and chamber 50. On the opposite side, element 52 is formed with an actuating portion 56. Portion 56 extends through an opening in the wall between chamber 32 and chamber 50, the opening being large enough to provide continuous fluid communication between chambers 32 and 50.

At its opposite end, the element 52 is formed with a hook portion 58 adapted to extend into a recess 59 in the piston 33, and also adapted to extend into a recess 60 in the piston 34. Pistons 33 and 34 are formed with projections 61 and 62.

With regard to the operation of the device, the pistons 33 and 34 move in a clockwise direction, considering the member 22 positioned as depicted in FIG. 3. In FIG. 3, the piston 33 is shown in a stationary position in which it is held by engagement of the hook portion 58 in the recess 59. It may be assumed that the piston 34 is moving in a clockwise direction toward the piston 33 under the influence of expanding fluid, it being noted that the valve element or portion 42 is in a closed position as shown in FIG. 3. At this point, fluid is being forced through the chamber 50, into passage 49, thence into chamber 48, thence through ports 47 into the chamber 46, and thence into the passage 45. The valve portion 54 is in an open position, as depicted in FIG. 3.

The pistons 33 and 34 are provided with the projections 61 and 62 and also with inclined cam faces 63 and 64, adapted to engage projections 43 and 56 of the valve elements 40 and 52. As the piston 34 moves further in a clockwise direction, the cam surface 64 engages the projection 56 of the valve element 52 to pivot element 52 in a counter-clockwise direction and to move valve portion 54 to a closed position, also moving the projection 58 out of the recess 59 to allow movement of the piston 33. At about the same time or shortly thereafter, the projection 62 of piston 34 may engage the piston 33 to positively move the piston 33 in a clockwise direction. The inertia of piston 34 carries it to the position of piston 33 as depicted in FIG. 3, at which time the projection 58 engages in the recess 60. At about this time or a short time later, the cam surface 63 of the piston 33 engages the projection 43 of element 40 to move the valve portion 42 to an open position. Fluid from the inlet passage 35 then flows through a chamber 36, ports 37, chamber 38 and passage 39 into the chanber 32 to act between the piston 34, then held in a stationary position by the projection 58, and the piston 33 to propel piston 33 in a clockwise direction. After the piston 33 passes beyond the projection 43, and after a certain amount of fluid is admitted, the spring 44 moves the valve element 40 to the position as illustrated to move the portion 42 to the closed position. The pressurized fluid then continues to propel the piston 33 in a clockwise direction to reach the position of piston 34 as illustrated, the operation being then continued in the manner as described.

The pistons 33 and 34 thus move relative to the member 22 in a circular path about the axis of the annular chamber 32.

In the illustrated arrangement, means are provided for effecting rotation of the member 22 about the axis of the shaft portion 24 thereof while the support member 12 is rotated about the common axis of the shaft portions 13 and 14 thereof. For this purpose, the member 22 is formed with a bevel gear portion 66 which is meshed with a stationary bevel gear 67 which may be formed as an integral part of the bearing member 17. As shown in FIGS. 1 and 2, the member 21 is also formed with bevel gear portion 68, similar to the bevel gear portion 66. Assuming that the support member 11 is rotating about its axis with the member 22 being rotated about its axis through the action of the bevel gears, the movement of the pistons will by virtue of Coriolis forces exert forces on the walls of the member 22 defining the chamber 32 in a manner such as to transmit torque to the support member 11.

To explain the operation of the device, consideration may be given to the effect on a particle located at a given point within the chamber 32. Such a particle will have an instantaneous rotational translational velocity along or parallel to a rotational velocity vector which in the illustrated embodiment will be along the line of contact between the bevel gear portions 66 and 67. Thus, in the position of the parts as illustrated in FIG. 1, the vector is indicated by broken line 70, in a horizontal plane through the axis of rotation of the member 11. If the particle is moving relative to the member 22 about the axis of the annular chamber 32, it will also have a relative velocity vector. The Coriolis force is given by the equation:

$$\vec{F}=2m\,\vec{w}\times\vec{v}$$

where $\vec{F}$ is the force, $\vec{w}$ is the instantaneous rotational translational velocity vector, $\vec{v}$ is the relative velocity vector, and m is the particle mass.

Figure 4:
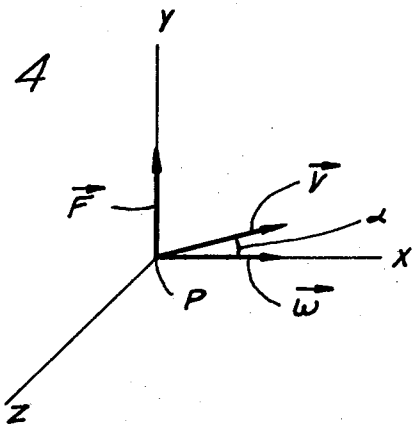
FIG. 4 diagrammatically illustrates the application of a Coriolis force on a particle for explanation of the devices of the invention.

With reference to determining the magnitude and direction of the force, FIG. 4 diagrammatically illustrates a condition in which the instantaneous rotational translational velocity vector $\vec{w}$ at a point P is along an X axis and the relative velocity $\vec{V}$ is in the horizontal X–Z plane, at an angle $\alpha$ relative to the X axis. The magnitude of the Coriolis force acting on the particle is given by the equation:

$$|F|=2|w|\,|v|\sin\alpha$$

Figure 5:
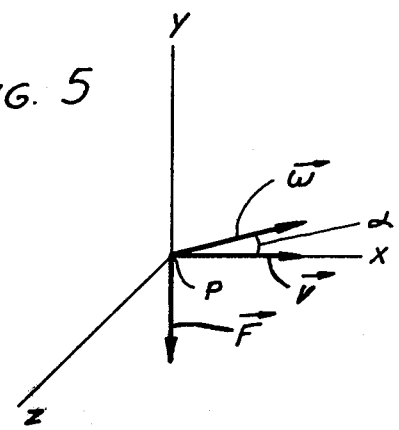
FIG. 5 is similar to FIG. 4, but illustrates a different condition.

The direction of the Coriolis force acting on the particle is upwardly along the Y axis. If the positions of the vectors are reversed as shown in FIG. 5, where the vector $\vec{v}$ is along the X axis and the vector $\vec{w}$ is in the horizontal x–z plane at the angle $\alpha$ relative to the X axis, the magnitude of the force is the same, but the direction is reversed, being downwardly along the Y axis.

If by a mechanical interconnection or relationshp the particle is constrained to move in its assumed path of movement and it is assumed that external forces act to move the particle, a reaction force is applied through such mechanical interconnection or relationship.

In the illustrated embodiment, forces are applied to the internal wall surfaces of the member 22 which define the chamber 32 by a piston moving around and around in the chamber 32. If such forces are analyzed, it will be found that if the members 11 and 22 are rotating conjointly about their respective axes, there will be a net integrated valve of torque applied. If the members 11 and 22 are not rotating, no torque is applied and it is therefore necessary to apply a starting torque to initiate rotation. Also, if the velocity of rotation of the members 11 and 22 is too high in relation to the velocity of movement of the pistons, there may be an undesirable counteraction. It may therefore be desirable to regulate the supply of steam or other fluid to the device in response to speed. It is noted, however, that there is stability in operation and the velocity or quantity or the steam or other fluid may vary over a wide range without destroying stability or balance.

Figure 9:
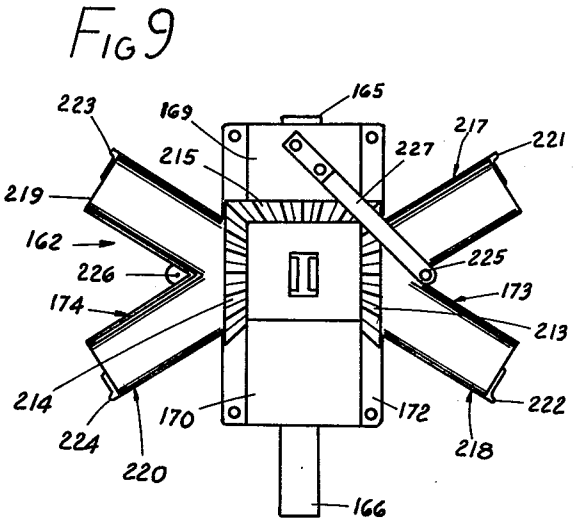
FIG. 9 is a top plan view of another embodiment of the invention.
Figure 10:
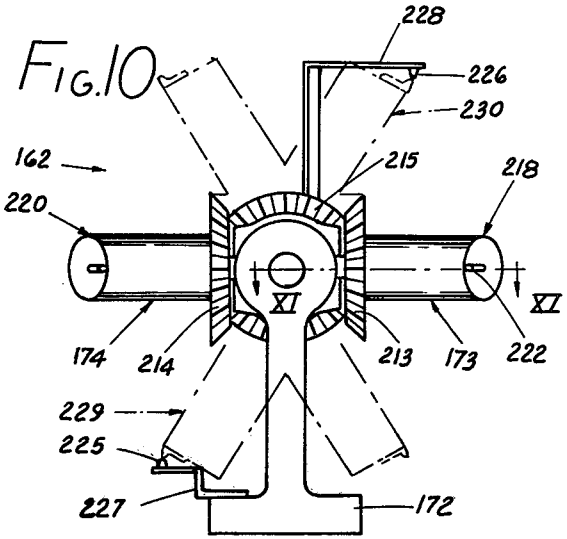
FIG. 10 is an elevational view of the embodiment of FIG. 9.
Figure 11:
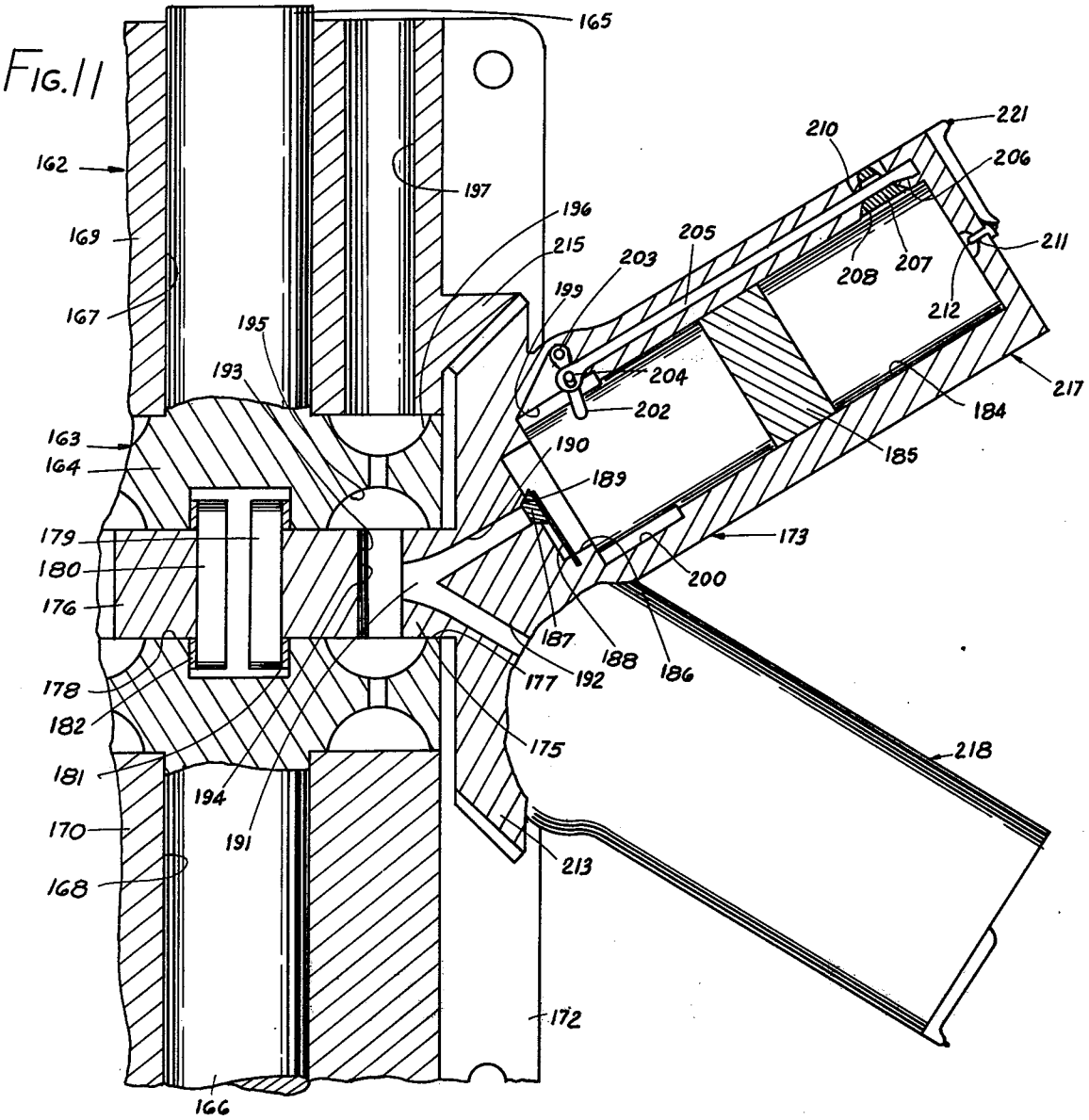
FIG. 11 is a cross-sectional view, taken substantially along line XI—XI of FIG. 10.

It is not essential to the development of the Coroilis forces that the pistons move in a circular path or that they move in a continuous path. The movement of the pistons may be oscillatory in a path which may be, but is not required to be, linear. An embodiment having oscillatory movement in a linear path is shown in FIGS. 9–11, described hereinafter.

Figure 6:
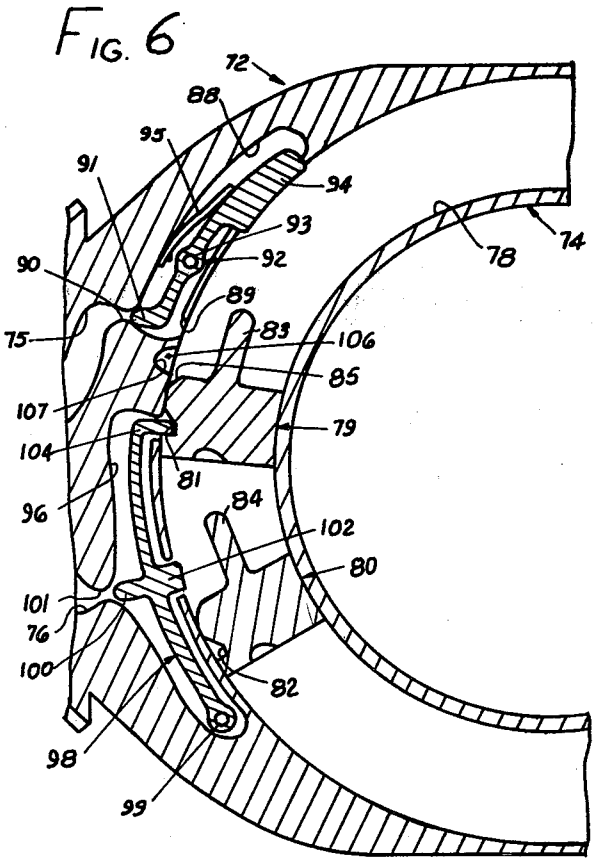
FIG. 6 is a cross-sectional view similar to FIG. 3, but illustrating a second embodiment designed for operation as an internal combustion engine.

FIG. 6 is a cross-sectional view similar to a portion of FIG. 3, illustrating part of a modified type of engine designed for internal combustion operation, the engine being generally designated by reference numeral 72. In the engine 72, a housing member 74 is provided, supported in the same way as the member 22 of the device 10 and including an inlet passage 75 and an outlet passage 76, respectively corresponding to the passages 39 and 49 in the member 22. A fuel-air mixture is supplied into the passage 75 through passages like the passages 35 and 37 of the device 10, preferably under substantial positive pressure which may be produced by an auxiliary compressor feeding the passage corresponding to the passage 35. The passage 76 operates as an exhaust passages, communicating with passages like the passages 47 and 45 of the device 10.

The housing 74 further includes an annular chamber 78 similar to the annular chamber 32 of the device 10 and a pair of pistons 79 and 80 which like the pistons 33 and 34, and include recesses 81 and 82, projections 83 ad 84 and cam surfaces 85 and 86, corresponding to the recesses 59 and 60, projections 61 and 62 and cam surfaces 63 and 64 of the pistons 33 and 34.

A chamber 88 in the housing 74 communicates with the chamber 78 through an opening 89 and communicates with the passage 75 through a restricted point 90 forming a valve seat engageable by a valve element 91 at the end of an arm 92 which is pivotally supported on a pin 93. At the opposite end, the arm 92 is formed with a portion 94 which projects through an opening in the wall of the member 74 between the chamber 88 and the annular chamber 78. A leaf spring element 95 urges the portion 94 inwardly to pivot the member 92 in a clockwise direction and to seat the valve element or portion 91 against the seat 90.

The member 74 is also formed with a chamber 96 adapted to communicate with the passage 76 under control of a valve element 98, which has a construction like that of the valve element 52 of the device 10. The valve element 98 is pivotally supported at one end by a pin 99 and, at an intermediate point, it is formed on one side with a valve portion 100 adapted to seat in an opening 101 of restricted size between passage 76 and chamber 96. On the opposite side, element 98 is formed with an actuating portion 102 which extends through an opening in the wall between chamber 96 and chamber 78, the opening being large enough to provide continuous fluid communication between chambers 96 and 78. At its opposite end, the element 98 is formed with a hook portion 104 adapted to extend into the recess 81 of the piston 79, as shown, and also adapted to extend into the recess 82 of the piston 80.

A spark plug is provided having points 106 positioned in a recess 107 in the wall of the chamber 78, adjacent the opening 89.

With regard to the operation of the engine 72, the pistons 79 and 80 are illustrated at positions such that piston 80, having been propelled by expanding gases in the region within chamber 78 extending in a clockwise direction from piston 79 and in a counter-clockwise direction from the piston 80, is near the end of a movement in which exhaust gases in the region extending in a counter-clockwise direction from the piston 79 and in a clockwise direction from the piston 80 are forced out through the opening in the wall through which projection 102 extends and into the chamber 96 and out into the passage 76. When the piston 80 moves further in a clockwise direction, cam surface 86 engages the projection 102 to move the valve element 98 to a closed position and to also release the hook portion 104 from the recess 81 and allow movement of the piston 79 when engaged by the projection 84. The piston 80 then moves to the position shown for piston 79 in the drawing, while the piston 79 moves in a clockwise direction to engage cam surface 85 with the projection 94 and to move a valve portion 91 away from the seat 90, so as to allow the pressurized air-fuel mixture to enter into the space between the pistons, through the opening 89. At about the time that the piston passes beyond the projection 94 in a clockwise direction, a spark is developed at the points 106 to ignite the air-fuel mixture and to propel the piston 79 around to the position in which the piston 80 is shown in FIG. 6, expelling exhaust gases out through the passage 76.

Figure 7:
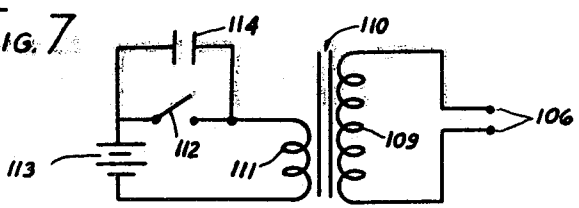
FIG. 7 illustrates diagrammatically an ignition circuit for the embodiment of FIG. 6.

With the pistons 79 and 80 being thus moved around and around in the chamber 78, Coriolis forces are evolved in the manner as described above and force is applied from the pistons to the walls of the housing 74, a torque is developed to cause rotation and to drive a suitable load. FIG. 7 shows an ignition circuit for the engine 72. The points 106 are connected to a secondary winding 109 of an ignition transformer 110 having a primary winding 111 connected through a switch 112 to a battery 113, a capacitor 114 being connected across the switch 112. The switch 112 may preferably be mechanically connected to the element 92 in a manner to be closed when the element 92 is rotated in a counter-clockwise direction as viewed in FIG. 6 and to be abruptly opened when the element 92 is moved back to its illustrated position. When the switch 112 is closed, the current builds up through the primary winding 119 and when the switch 112 is abruptly opened, a high voltage is developed across the secondary winding 109, by the collapse of the inductive field, and a spark is developed between the points 106. Capacitor 114 reduces arcing across the switch 112.

Transformer 110 may be conveniently carried by the member 74 and the voltage from the battery 113 may be applied through suitable slip rings, if desired. It will be appreciated, of course, that the points 106 of the spark plug may be connected to any suitable ignition circuit through suitable slip rings, with suitable means being provided to synchronize the application of the spark to the movements of the pistons, as desired.

Figure 8:
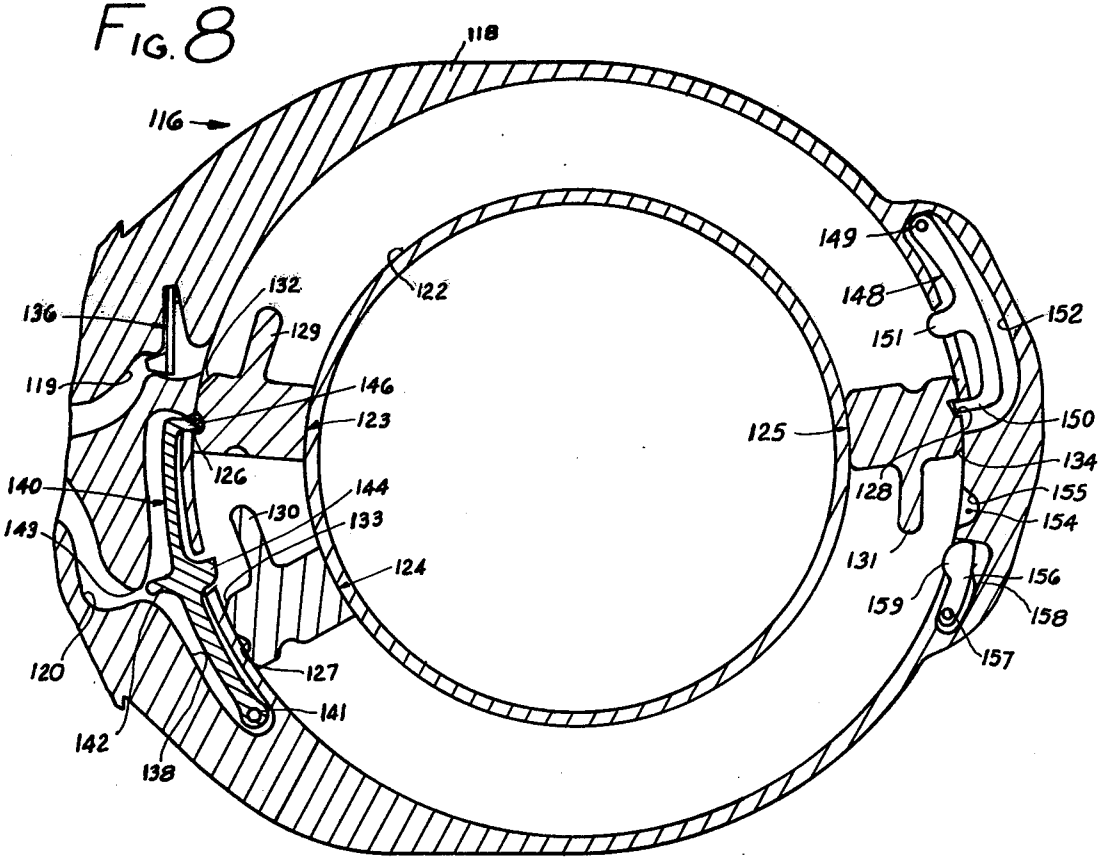
FIG. 8 is a cross-sectional view similar to a portion of FIG. 3, illustrating another embodiment of the invention, also designed for use as an internal combustion engine.

It will be noted that the engine 32 of FIG. 6 operates in a manner similar to a two-stroke cycle engine, which may require an auxiliary compressor to supply the fuel-air charge. FIG. 8 illustrates a modified type of engine, generally designated by reference numeral 116, which operates in a manner similar to a four-stroke cycle engine. The engine 116 comprises a housing member 118, preferably supported in the same way as the member 22 of the device 10 and including an inlet passage 119 and an outlet passage 120. A fuel-air mixture is supplied into the passage 119 through passages like the passages 35 and 37 of the device 10. The passage 120 operates as an exhaust passage, communicating with passages like the passages 47 and 45 of the device 10.

The housing member 118 further includes an annular chamber 122 similar to the annular chamber 32 of the device 10 and three pistons 123, 124 and 125 which are like the pistons 33 and 34 and which include recesses 126, 127 and 128, projections 129, 130 and 131 and cam surfaces 132, 133 and 134.

The fuel-air inlet passage 119 communicates with the chamber 122 through a one-way flap valve device 136.

The housing member 118 is also formed with a chamber 138 adapted to communicate with the exhaust passage 120 under control of a valve element 140 which has a construction like that of the valve element 52 of the device 10. The valve element 140 is pivotally supported at one end by a pin 141 and, at an intermediate point, it is formed on one side with a valve portion 142 adapted to seat in an opening 143 of restricted size between passage 120 and chamber 138. On the opposite side, element 140 is formed with an actuating portion 144 which extends through an opening in the wall between chamber 138 and chamber 122, the opening being large enough to provide continuous fluid communication between chambers 138 and 122. At its opposite end, the element 140 is formed with a hook portion 146 adapted to extend into the recess 126 of the piston 123, as shown, and also adapted to extend into the recesses 127 and 128 of the pistons 124 and 125.

At the outer end of the housing 118, means are provided for releasably holding a piston in position, including an element 148 pivotally supported by a pin 149 and having a hook portion 150 at the opposite end, adapted to extend into the recess 128 of the piston 125, as shown, and also adapted to extend into the recesses 126 and 127 of the pistons 123 and 124. At an intermediate point, the element 148 has an actuating portion 151 which extends through an opening in the wall of the member 118, between the annular chamber 122 and a chamber 152 in which the element 148 is disposed.

A spark plug is provided having points 154 positioned in a recess 155 in the wall of the chamber 122, positioned in a clockwise direction from the releasable stop element 148. For control of ignition, an element 156 is pivotaly mounted on a pin 157 and is urged inwardly by a spring element 158, element 156 having an actuating portion 159 engagable by the cam surfaces 132–134 of the pistons 123–125. The pin 157 may be connected to a switch such as the switch 112 of the circuit illustrated in FIG. 7.

With regard to the operation of the engine 116, the pistons 123 and 125 are illustrated in stationary positions in FIG. 8, being held by the hook portions 146 and 150 of the element 140 and 148. At this point, the space between pistons 123 and 125 is filled with the air-fuel mixture. The piston 124 is moving in a clockwise direction propelled by expanding gases in the region between piston 124 and 125, and exhaust gas is being discharged out into the passage 120 from the space between pistons 123 and 124. As the piston 124 moves further in a clockwise direction, the cam surface 133 engages the actuating portion 144 of the element 140 to seat the valve portion 142 against the seat 143 and to move the hook portion 146 out of the recess 126 in the piston 123. The projection 130 of piston 124 then engages the piston 123 to accelerate it in a clockwise direction and when the piston 124 reaches the position in which piston 123 is illustrated in FIG. 8, the hook portion 146 of the element 140 engages in the recess 127 of the piston 124 to hold piston 124 in a stationary position. Piston 123 is accelerated by forces developed as a result of rotation of the member 118 about its axis and rotation of the support structure about the principal axis of rotation. As piston 123 moves in a clockwise direction, the fuel-air mixture is drawn in between pistons 123 and 124, flowing past the one-way valve 136. At the same time, the fuel-air mixture is the region between pistons 123 and 125 is compressed.

When the piston 123 approaches the piston 125, the cam surface 132 engages the actuating portion 151 to move the hook portion 150 out of the recess 128 and then when the projection 129 of piston 123 engages the piston 125, the piston 125 is moved in a clockwise direction. When piston 123 reaches the position in which piston 125 is illustrated in FIG. 8, the projection engages in the recess 126 to hold the piston 123 in a stationary position. When piston 125 moves in a clockwise direction, the cam surface 134 engages the actuating portion 159 of the element 157 to move it in a clockwise direction and when it passes the portion 159, the element 156 is moved back in a counter-clockwise direction by the spring 158. At this time, a spark is developed between the points 154 to ignite the compressed fuel-air mixture between pistons 123 and 125. Piston 125 is then driven in a clockwise direction to exhaust fluid out from the space between pistons 125 and 124 and a sequence of operations as above described is repeated.

Referring to FIGS. 9–11, reference numeral 162 generally designates another form of engine constructed in accordance with the principles of this invention, using pistons having oscillatory movements. The engine 162 comprises a rotatable support member 163 which includes a central portion 164 and oppositely projecting shaft portions 165 and 166 journalled in bearing openings 167 and 168 of a pair of members 169 and 170 which are supported through depending leg portions thereof from a base member 172. The central portion 164 of the rotatable member 163 carries a pair of housing members 173 and 174 which have integral shaft portions 175 and 176 journalled in bearing openings 177 and 178 in the member 163, for rotation about a common axis which is transverse to the axis of rotation of the member 163. A pair of collars 179 and 180 are secured to the inner ends of the shaft portions 175 and 176 and suitable thrust bearing elements 181 and 182 may be provided between the outer faces of the collars 179 and 180 and inwardly facing surface portions of the member 163.

Each of the housing members 173 and 174 has a pair of cylindrical chambers therewithin with a piston disposed in each chamber, the construction with respect to one of the chamber and its associated pistons being shown in cross-section in FIG. 11. The construction with respect to the other chamber of member 173 and with respect to the chambers of member 174 is substantially the same.

One of the cylindrical chambers in member 173 is indicated by reference numeral 184 and the associated piston as indicated by reference numeral 185. At its inner end, the chamber 184 communicates with a chamber 186 of slightly reduced diameter within which a valve member 187 is disposed, valve member 187 being carried by a leaf spring member 188. The valve member 187 is arranged to engage in a valve seat 189 at the outer end of a passage 190 in the member 173 and controls communication between passage 190 and the chambers 186 and 184. A common passage 191 communicates with the inner end of the passage 190 and also with the inner end of a passage 192 extending to the second cylindrical chamber of the member 173. The inner end of the common passage 191 communicates through transverse passages 193 and 194 in the shaft portion 175 of member 173 with an annular chamber 195 in the portion of member 163 which surrounds the shaft portion 175 and chamber 195, in turn, communicates with an annular chamber 196 in an axially facing surface of the central portion 164 of member 163, the axis of the annular chamber 196 being coincident with the axis of rotation of member 163. Chamber 196 communicates with an inlet passage 197 in the bearing member 169.

A fuel-air mixture is supplied through a suitable carburetor device into the passage 197 to flow through chambers 196 and 195 into passages 193 and 194 and thence through the passage 191 into the passages 190 and 192.

A pair of diametrically opposed axially extending grooves 199 and 200 are formed in the wall of the member 173 at the inner end of the chamber 184, the grooves 199 and 200 having an axial length substantially greater than the axial length of the piston 185 so that when the piston is at an inward position, the fuel-air mixture can flow past the valve member 187, through chamber 186 and thence through grooves 199 and 200 around the outside of the piston 185 and into the space in the chamber 184 on the outside of the piston 185. At the same time, the piston 185 engages the end of an arm 202 pivotally supported by a pin 203 and connected through a pin 204 to one end of a rod 205 movable in an axial direction parallel to the axis of movement of the piston 185. At its outer end, the rod 205 is formed with a cam surface 206 arranged to engage a surface of an exhaust valve member 207 which is adapted to engage a valve seat 208. When valve member 207 is moved inwardly away from the seat 208, exhaust gases can flow past the seat 208 and out through an exhaust passage 210 to the atmosphere.

Thus, when the piston 185 is moved to an inward position opposite the grooves 199 and 200 and in which it engages the end of the arm 202, the fuel-air mixture can flow into the inner end to the chamber 184 while exhaust gases flow out through the outer end of the chamber, through passage 210. The piston 185 is then moved outwardly by forces acting thereon, as hereinafter explained, to compress the fuel-air mixture and when it is at an outermost position and at an appropriate angular position of the member 173, a spark is applied to the compressed fuel-air mixture. In particular, a spark plug is provided having a pair of points 211 and 212.

It is noted that when the piston 185 moves outwardly, a fresh charge is drawn into the inner end of the chamber 184, through the valve 187 and when the piston 185 is driven inwardly by combustion of the fuel-air mixture in the outer end, the charge so drawn in is compressed, the valve 187 being closed, so that when the piston reaches its inward position, the charge is under substantial pressure to flow through the grooves 199 and 200 around the piston and into the outer end of the chamber to clear exhaust gases from the previous combustion therefrom.

Means are provided for effecting rotation of the housing members 173 and 174 about their common axis while the support member 163 is rotated about the principal axis, i.e. the common axis of the shaft portions 165 and 166 thereof. In particular, bevel gears 213 and 214 are provided on the members 173 and 174 which gears are meshed with a stationary bevel gear 215 secured to or formed as an integral part of the stationary bearing member 169.

It is noted that the member 173 carries two piston-cylinder units, the unit described above, including the cylindrical chamber 184 and piston 185, being generally designated by reference numeral 217 and the second unit being generally designated by reference numeral 218. Similarly, the member 174 carries two units generally designated by reference numerals 219 and 220. The axis of each of the units 217–220 is at an angle to the axis of rotation of the associated housing member. In the illustrated embodiment, the axes of the units 217 and 218 are in a common plane through the axis of rotation of the member 173 and each axis is at an angle of approximately 30 degrees relative to the axis of rotation of the member 173, there being approximately a 60 degree angle between the axes of the units 217 and 218. Similarly, the axes of units 219 and 220 are in a common plane through the axis of rotation of the member 174 and each is at an angle of approximately 30 degrees relative to the axis of rotation of the member 17, there being approximately a 60 degree angle between the axes of units 219 and 220.

An analysis of the Coriolis forces developed with respect to the oscillatory pistons in the embodiment of FIGS. 9–11, using the principles explained hereinabove, shows that when the main support member 163 is rotated about the principal axis to cause rotation of the housing members 173 and 174 about their common axis, through the bevel gears 213–215, oscillatory movement of the pistons will develop an output torque to maintain such rotation, overcoming friction and supplying torque to a load coupled to the shaft portion 166. Preferably, the combustion in each unit is initiated to move the piston thereof inwardly when the unit is moving from a position in which the axis thereof is in a plane through the axis of rotation of the associated housing member and transverse to the principal axis toward a position in which the axis of the unit is generally parallel to the rotational velocity vector, i.e. parallel to the line of contact between the bevel gear of the associated housing member and the stationary bevel gear.

In the illustrated embodiment, a commutation arrangement is illustrated for applying the spark to the units for effecting combustion in the preferred manner.

In the unit 217, the spark plug point 211 is connected to a contact 221 on the outside of the housing member 173 with the point 212 being grounded to the housing. The units 218, 219 and 220 are provided with outside contacts 222, 223 and 224, similar to the contact 221. Such contacts 221–224 are engagable with stationary contacts 225 and 226 supported by brackets 227 and 228.

Assuming that the main support member 163 is rotating about the principal axis in a clockwise direction as viewed in FIG. 10, each of the housing members 173 and 174 will rotate in a counter-clockwise direction, as viewed from the outside, looking toward the principal axis of rotation. When the main support member 163 is rotated 90 degrees clockwise from the position illustrated in the drawings, the housing member 173 will rotate 90 degrees in a counter-clockwise direction to position unit 218 in a position as diagrammatically indicated by broken lines 229 in FIG. 10, at which contact 222 engages contact 225. At the same time, the housing member 174 will rotate in a counter-clockwise direction to position unit 220 in a position as diagrammatically indicated by broken lines 230 in FIG. 10 at which contact 226 is engaged with contact 224. At this time, a high voltage pulse may be applied to contacts 225 and 226 to cause ignition of the compressed air-fuel mixtures in the units 218 and 220.

When the main support member 163 is rotated 270 degrees clockwise from the position illustrated in the drawings, the housing members 173 and 174 will rotate 270 degrees in counter-clockwise directions as viewed from the outside looking toward the principal axis of rotation, and the unit 219 will be in the position as indicated by broken lines 229 while the unit 217 will be in the position as indicated by broken lines 230. At this time, a high voltage pulse may be again applied to contacts 225 and 226 to cause ignition of compressed air-fuel mixtures in the units 217 and 219.

It will be noted that following each such ignition in a unit, the piston of the unit will be propelled inwardly while the axis of the unit is moving toward a position generally perpendicular to the instantaneous rotational translational velocity vector, so that a positive torque is applied as a result of Coriolis forces.

It is further noted that after the piston of a unit is driven inwardly by combustion of the air-fuel mixture, it is moved back outwardly by the combined action of the force of the compressed fuel-air mixture in the inner end of the cylinder and centrifugal forces arising from the rotation about the principal axis and the rotation of the housing member about its axis. The return movement preferably takes place during an interval of time when any Coriolis forces acting in opposition to the desired direction of torque application are at a minimum. After the piston is moved back to its outward position, it can remain until a spark is applied to the compressed fuel-air mixture at the appropriate time and in the manner as described above.

It will be understood that the disclosed embodiments are intended to be illustrative of the principles of the invention and that modifications and variations may be effected. The movement of the pistons may be in paths other than annular paths or linear paths and may cross the principal axis of rotation as well as the axis of rotation of the housing member. It is not essential that the axis of rotation of the housing member be at right angles to the principal axis and it may be at some other angle, so long as Coriolis forces are developed using the principles set forth. Also, it is noted that terms such as "housing member" and "piston" are used in a broad sense to mean, respectively, a member rotatable about an axis and a second member movable relative thereto. Conceivably, a construction might be used in which what might be technically referred to as a piston is the approximate equivalent of a housing member as disclosed, and vice versa. It is further noted that the common joint rotations obtained through the use of bevel gears in the illustrated embodiments may be effected by other means. Sealing devices such as piston rings are not shown or described in the illustrated embodiments, but it will be understood that such may be readily incorporated. Suitable fly wheels may be provided to obtain smoother operation.

It will be understood that other modifications and variations may be effected without departing from the spirit and scope of the novel concepts of this invention.

I claim as my invention:

1. In a device for energy conversion between rotational mechanical motion and fluid flow, rotatable drive means journalled for rotation about a first axis, means for coupling said rotatable drive means to load means for driving said load means, a housing member defining a chamber therewithin, at least one piston member movable within said chamber of said housing member with said chamber and said piston member having substantially the same cross-sectional size and shape, means supporting one of said members from said rotatable drive means for movement relative to said rotatable drive means about a second axis in fixed relation to said rotatable drive means and in non-parallel relation to said first axis with said second axis being thereby rotatable with said rotatable drive means about said first axis, means establishing communication between said fluid inlet and outlet means and said chamber, means defining a wall cooperating with said piston member and with internal wall portions of said chamber engaged by said piston member to define a space which during movement of said piston member relative to said housing member changes in volume betweem minimum volume and maximum volume conditions, and means whereby fluid in said space in pressurized in said minimum volume condition to increase the volume of said space and move said piston member in a direction to exert forces against said internal wall portions of said chamber to assist movement of said one of said members about said second axis and rotation of said drive means and said second axis about said first axis and to drive said drive means.

2. In a device as defined in claim 1, said chamber of said housing member being of generally annular form, said wall being defined by a second piston member in said chamber with there being at least two of said piston members movable around and around within said chamber of said housing member.

3. In a device as defined in claim 2, wherein first, second and third piston members are provided, means for holding said first and second piston members in predetermined stationary positions while said third piston member operates to draw in an air-fuel mixture between it and said first piston member while compressing an air-fuel mixture between it and said second piston member, and means operative during a later part of the same operating cycle for holding said first and third piston members in stationary positions while said second piston member is propelled by combustion between it and said third piston member toward said first piston member to exhaust gases from the space therebetween.

4. In a device as defined in claim 2, means for temporarily holding each piston in a predetermined stationary position with said fluid inlet means being in communication with the portion of said chamber on one side of a piston in said stationary position and with said fluid outlet means being in communication with a portion of the chamber on the opposite side of a piston in said stationary position.

5. In a device as defined in claim 4, said fluid inlet means being arranged to supply a fuel-air mixture, and means for igniting said fuel-air mixture within said chamber to move the piston which is not in said stationary position.

* * * * *